US008144548B2

(12) United States Patent
Gamo et al.

(10) Patent No.: US 8,144,548 B2
(45) Date of Patent: Mar. 27, 2012

(54) ELECTRONIC DEVICE, TIME CORRECTION METHOD AND TIME CORRECTION PROGRAM THEREOF

(75) Inventors: Tatsuya Gamo, Kamakura (JP); Makoto Sugimoto, Kawasaki (JP); Yoshiaki Kikuchi, Kawasaki (JP); Yuko Nakajima, Kawasaki (JP); Makoto Nakano, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 877 days.

(21) Appl. No.: 11/239,399

(22) Filed: Sep. 30, 2005

(65) Prior Publication Data

US 2006/0234671 A1 Oct. 19, 2006

(30) Foreign Application Priority Data

Apr. 15, 2005 (JP) ..... 2005-118672

(51) Int. Cl.
*G04C 11/02* (2006.01)

(52) U.S. Cl. ..... 368/47; 368/13

(58) Field of Classification Search ..... 368/47, 368/13

See application file for complete search history.

(56) References Cited

U.S. PATENT DOCUMENTS

| | | | | |
|---|---|---|---|---|
| 4,234,958 | A * | 11/1980 | Pipes et al. | 375/356 |
| 5,724,316 | A * | 3/1998 | Brunts | 368/10 |
| 6,212,370 | B1 | 4/2001 | Itou | |
| 2003/0174584 | A1 | 9/2003 | Fujisawa et al. | |
| 2003/0198140 | A1 | 10/2003 | Shimizu | |

FOREIGN PATENT DOCUMENTS

| | | | |
|---|---|---|---|
| CN | 1441330 | | 9/2003 |
| CN | 1447198 | | 10/2003 |
| JP | 09044425 | A | 2/1997 |
| JP | 10-55224 | A | 2/1998 |
| JP | 10-70747 | A | 3/1998 |
| JP | 2000356692 | A | 12/2000 |
| JP | 2002-156478 | | 5/2002 |
| JP | 2002-156478 | A | 5/2002 |
| JP | 2002174689 | A | 6/2002 |
| JP | 2002216280 | A | 8/2002 |

OTHER PUBLICATIONS

Chinese Office Action, Application No. 200510115629.1; Jan. 11, 2008; 11-pages.

Extended European Search Report dated Mar. 6, 2009 issued in corresponding European Patent Application No. 05256191.7.

European Office Action dated Dec. 8, 2009 issued in corresponding European Patent Application No. 05256191.7.

European Office Action issued in corresponding European Patent Application No. 05256191.7-1240 dated Nov. 4, 2010.

Japanese Office Action dated Jan. 25, 2011 issued in corresponding Japanese Patent Application No. 2005-118672.

* cited by examiner

*Primary Examiner* — Sean Kayes
(74) *Attorney, Agent, or Firm* — Murphy & King, P.C.

(57) ABSTRACT

An electronic device corrects its device side time with a time correction information supplied from outside the device. The electronic device includes a reception section and a time correction section. The reception section receives the time correction information. The time correction section judges whether the information is received during any correction inhibiting periods of the device side time, then either discards the time correction information if it is received during the correction inhibiting periods, or corrects the device side time with the time correction information if it is received other than the correction inhibiting periods.

4 Claims, 19 Drawing Sheets

ELECTRONIC DEVICE, TIME CORRECTION METHOD AND TIME CORRECTION PROGRAM THEREOF

CROSS-REFERENCE TO RELATED APPLICATIONS

This application is based upon and claims the benefit of priority from the prior Japanese Patent Application No. 2005-118672, filed on Apr. 15, 2005, the entire contents of which are incorporated herein by reference.

BACKGROUND OF THE INVENTION

1. Field of the Invention

The present invention relates to automatic time correction of an electronic device such as mobile terminal devices, and more specifically relates to an electronic device that automatically corrects its time by using a time correction information supplied from base stations or a network outside the device, and to a time correction method and a time correction program thereof.

2. Description of the Related Art

Various types of electronic devices such as mobile terminal devices use time information for various types of managing information such as time display function, schedule function, time setting function like a wake-up time setting, stopwatch function; and provide a function of automatically correcting the device side time with a time correction information supplied from outside the device. For this time correction, mobile terminal devices use a time correction information supplied from base stations or the network connected to the base stations. This time correction information may be supplied periodically in about every hour or unperiodically.

In regard to such time correction technologies, among conventional patent documents, there is one in which portable terminal side requests the transmission of time information to a base station and receives the time information corresponding to the request from the base station side (e.g., Japanese Patent Application Laid-Open Publication No. 2002-156478 (paragraph Nos. 0028, 0031, FIG. 2, etc.)); one that corrects its time by a time information transmitted periodically from a base station (e.g., Japanese Patent Application Laid-Open Publication No. H10(1998)-70747 (paragraph No. 0025, FIG. 2, etc.)); and one that sets a time band for inhibiting a time correction, by focusing that performing time corrections in devices increases data errors in the processing of data pertaining to time length (e.g., Japanese Patent Application Laid-Open Publication No. H10(1998)-55224 (paragraph Nos. 0017, 0018, FIG. 2, etc.)).

By the way, if a timer is set within a mobile terminal device, and when the device side time is corrected by a supplied time correct information, the timer is reset to become accurate. When the timer in the device is reset, each application resets its respective timer by capturing the times before and after the time correction takes place in the device and by calculating remaining time in its respective timer. This processing of resetting each timer in each application takes a certain amount of time and the system controlling over each application has no means to find whether each timer reset is completed or not since each application does not report completion of its timer reset to the system.

The above problem does not occur when a time correction is manually performed. However, when a time correction is automatically performed with a time correction information supplied from the network and the like, then inconveniences such as the following arise. That is, confusion may be caused in the processing of time correction if the time correction information is supplied while an application is performing its time correction. In such a case, resetting the timer might be failed. Further, some applications have the timing at which performing time correction is impossible even though the time correction information is supplied.

Such inconveniences might arise not only in the mobile terminal devices, but also in the electronic devices executing applications that use time information, when the devices perform time correction upon receipt of the time correction information.

None of the above-described Japanese Patent Application Laid-Open Publication Nos. 2002-156478, H10(1998)-70747, H10(1998)-55224 disclose nor suggest such issues, and there is no descriptions or suggestions to solve those issues.

SUMMARY OF THE INVENTION

The object of the present invention is to enable an electronic device that corrects its device side time with a time correction information supplied from outside the device to perform the time correction appropriately.

Each aspect of the configurations of the present invention in which the above-described issues have been solved will be listed and explained hereinafter.

According to a first aspect of the present invention there is provided an electronic device that corrects its device side time with a time correction information supplied from outside the device, comprising a reception section that receives the time correction information; and a time correction section that judges whether any correction inhibiting periods of the device side time is applicable or not, then either discards the time correction information if any of the correction inhibiting periods is applicable, or corrects the device side time with the time correction information if none of the correction inhibiting periods is applicable.

According to this configuration, a time correction information supplied from outside the device is received at the reception section; and if the information is received during any correction inhibiting periods, the received time correction information is discarded; or if the information is received other than the correction inhibiting periods, then the device side time is corrected. Here, "outside the device" indicates such as base stations and a network. Further, the time correction inhibiting periods consist of plural time periods, for example, such as the following.

(1) A certain period after power-on (T1);

(2) A period while a time correction is in progress, the period for preventing repetition of correction by another time correction information that is supplied during the processing of time correction (T2) (=a certain period during which the processing of time correction is prohibited in order to prevent a repeat of correction);

(3) A certain period after the processing of time correction is completed (T3);

(4) A certain period that can be set arbitrary other than these (1) through (3) (T4).

The time correction inhibiting periods consist of one or a plurality of the above-described time periods. By setting such correction inhibiting periods, since the device side time will not be corrected during the correction inhibiting periods even though a time correction information is supplied periodically or unperiodically, thus confusion caused by receiving another time correction information while correction of the device side time is in progress and wrong corrections can be prevented.

In the first aspect of the present invention, if the device side time has been corrected with the supplied time correction information, it is preferable that a correction inhibiting period be set for a certain time after the correction, during which any time correction information that is supplied is discarded and correction of the device side time is prohibited. According to this configuration, repeated correction of the device side time can be prevented, and the impact of time correction on the programs and the like of the device side can be avoided.

According to a second aspect of the present invention there is provided an electronic device that corrects its device side time with a time correction information supplied from outside the device, comprising a reception section that receives the time correction information; a retention section that retains the time correction information received at the reception section; and a time correction section that corrects the device side time by using the time correction information retained in the retention section.

According to this configuration, a time correction information supplied from outside the device is received at the reception section and retained in the retention section, and the device side time is corrected with this time correction information retained in the retention section. When the time correction information is supplied periodically or unperiodically from outside the device, the time correction information that is supplied is retained independently of the functions and operations of the device side, so that time correction can be performed at the right time with the use of the time correction information. Therefore, also with this configuration, confusions caused by the supplied information or wrong correction can be prevented.

In the second aspect of the present invention, if any of the correction inhibiting periods of the device side time is applicable, it is preferable that the retention section retain the time correction information. According to this configuration, if any of the correction inhibiting periods is set, correction of the device side time with the supplied time correction information is enabled except for the correction inhibiting periods. Therefore, a configuration may be used in which a time correction information is retained if it is supplied during the correction inhibiting periods.

In the second aspect of the present invention, it is preferable to decide a correction time by adding a time difference between the time of the time correction information and the instant when a time correction takes place, to the time of the correction time information retained in the retention section. According to this configuration, since the time difference that may arise between the time that the time correction information indicates and the time when the time correction actually takes place can be complemented by measuring and adding its time span to the time of the supplied time correction information, the device side time can be corrected accurately.

According to a third aspect of the present invention there is provided a time correction method of an electronic device that corrects its device side time with a time correction information supplied from outside the device, comprising the processing of receiving the time correction information; judging whether any correction inhibiting periods of the device side time is applicable or not; and discarding the time correction information if any of the correction inhibiting periods is applicable, or correcting the device side time with the time correction information if none of the correction inhibiting periods is applicable.

According to this configuration, the processing of receiving the time correction information; judging whether any of the correction inhibiting periods is applicable or not; discarding the time correction information if any of the correction inhibiting periods is applicable, or correcting the device side time if none of the correction inhibiting periods is applicable are performed, so that time correction can be performed appropriately and inconveniences caused by repetition of time correction can be avoided as well.

According to a fourth aspect of the present invention there is provided a time correction method of an electronic device that corrects its device side time with a time correction information supplied from outside the device, comprising the processing of receiving the time correction information; retaining the received time correction information; and correcting the device side time by using the retained time correction information.

According to this configuration, the processing of receiving a time correction information; retaining the received time correction information; and correcting the device side time with the retained time correction information are performed, and with these processing, time correction can be performed at the right time by using the retained time correction information.

In the fourth aspect of the present invention, it is preferable to include the processing of judging whether any correction inhibiting periods of the device side time is applicable or not; and retaining the time correction information if any correction inhibiting periods of the device side time is applicable. According to this configuration, by retaining the time correction information while any of the correction inhibiting periods of the device side time is applicable, time correction can be performed at the end of the correction inhibiting periods with the use of the retained time correction information.

In the fourth aspect of the present invention, it is preferable to include the processing of computing a correction time by adding a time difference between the time of the time correction information and the instant when a time correction takes place, to the time of the retained correction time information. According to this configuration, the time difference between the time of the retained time correction information and the time when the correction actually takes place can be complemented and the device side time can be corrected accurately.

According to a fifth aspect of the present invention there is provided a time correction program executed by a computer, the time correction program of an electronic device that corrects its device side time with a time correction information supplied from outside the device, comprising the steps of receiving the time correction information; judging whether any correction inhibiting periods of the device side time is applicable or not; and discarding the time correction information if any of the correction inhibiting periods is applicable, or correcting the device side time with the time correction information if none of the correction inhibiting periods is applicable. According to this configuration, by the computer processing, the time correction information supplied from outside the device is discarded during the correction inhibiting periods; or correction of the device side time is performed except for the correction inhibiting periods.

To solve the above described issues, in the previously described electronic device, the correction inhibiting period may be configured as a period of time after power-on, a period of time continuing functionally or a period of time reserved for the device side. And the electronic device may further include a time-measuring section that measures a time span between the instant when the reception section receives the time correction information and the instant when a time correction takes place.

According to a sixth aspect of the present invention there is provided a time correction program executed by a computer, the time correction program of an electronic device that corrects its device side time with a time correction information supplied from outside the device, comprising the steps of receiving the time correction information; retaining the received time correction information; and correcting the device side time by using the retained time correction information.

According to this configuration, by the computer processing, the processing of receiving a time correction information; retaining the time correction information; and correcting the device side time by using the time correction information are performed, and with these processing, time correction can be performed at the right time by using the retained time correction information.

To solve the above-described issues, the previously described time correction program of an electronic device may further comprise the steps of judging whether any correction inhibiting periods of the device side time is applicable or not; and retaining the time correction information if any of the correction inhibiting periods of the device side time is applicable; or may further comprise the step of computing a correction time by adding a time difference between the time of the time correction information and the instant when a time correction takes place, to the time of the retained correction time information.

According to a seventh aspect of the present invention there is provided a mobile terminal device that corrects its device side time with a time correction information supplied from base stations, comprising a reception section that receives the time correction information; and a time correction section that judges whether any correction inhibiting periods of the device side time is applicable or not, then either discards the time correction information if any of the correction inhibiting periods is applicable, or corrects the device side time with the time correction information if none of the correction inhibiting periods is applicable.

According to this configuration, a time correction information supplied from outside the mobile terminal device is received at the reception section; and if the information is received during any correction inhibiting periods, the received time correction information is discarded; or if the information is received other than the correction inhibiting periods, then the device side time is corrected.

According to an eighth aspect of the present invention there is provided a mobile terminal device that corrects its device side time with a time correction information supplied from base stations, comprising a reception section that receives the time correction information; a retention section that retains the time correction information received at the reception section; and a time correction section that corrects the device side time by using the time correction information retained in the retention section.

According to this configuration, a time correction information supplied from outside the mobile terminal device is received at the reception section and retained in the retention section, and the device side time is corrected with this time correction information retained in the retention section. When the time correction information is supplied periodically or unperiodically from outside the device, the time correction information that is supplied is retained independently of the functions and operations of the device side, so that time correction can be performed at the right time with the use of the time correction information.

In the eighth aspect of the present invention, it is preferable that the retention section retain the time correction information if any of the correction inhibiting periods of the device side time is applicable.

Features and advantages of the present invention will be listed hereinbelow.

(1) Even though a time correction information is supplied from outside the device periodically or unperiodically, since the device side has set the time correction inhibiting periods and performs its time correction other than the time correction inhibiting periods, its time correction can be performed at the right time and a wrong correction or a malfunction at the device side can be prevented.

(2) By configuring that the time correction information supplied from outside the device is retained, time correction can be performed at the right time by using the retained time correction information and a wrong correction or a malfunction at the device side can be prevented.

The above and other objects, features and advantages of the present invention will become more apparent from the following detailed description when taken in conjunction with the accompanying drawings.

BRIEF DESCRIPTION OF THE DRAWINGS

FIG. 5 is a flowchart showing the setting of T1, a time correction inhibiting period immediately after power-on;

FIGS. 9 (A), 9 (B) are diagrams showing a time correction inhibiting period T1 generating immediately after power-on;

DETAILED DESCRIPTION OF THE PREFERRED EMBODIMENTS

First Embodiment

Figure 1:
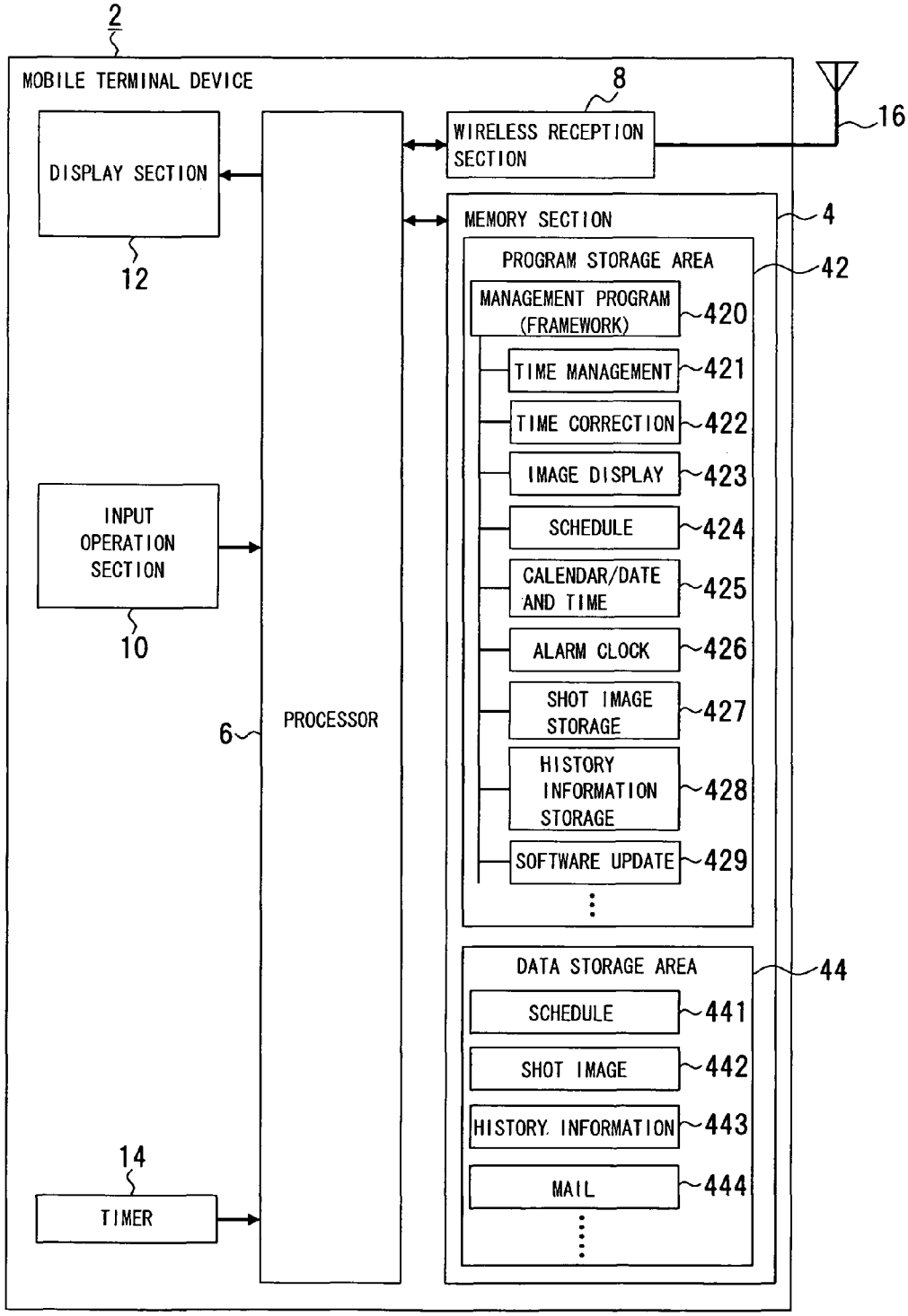
FIG. 1 is a block diagram showing a mobile terminal device according to a first embodiment of the present invention.
Figure 2:
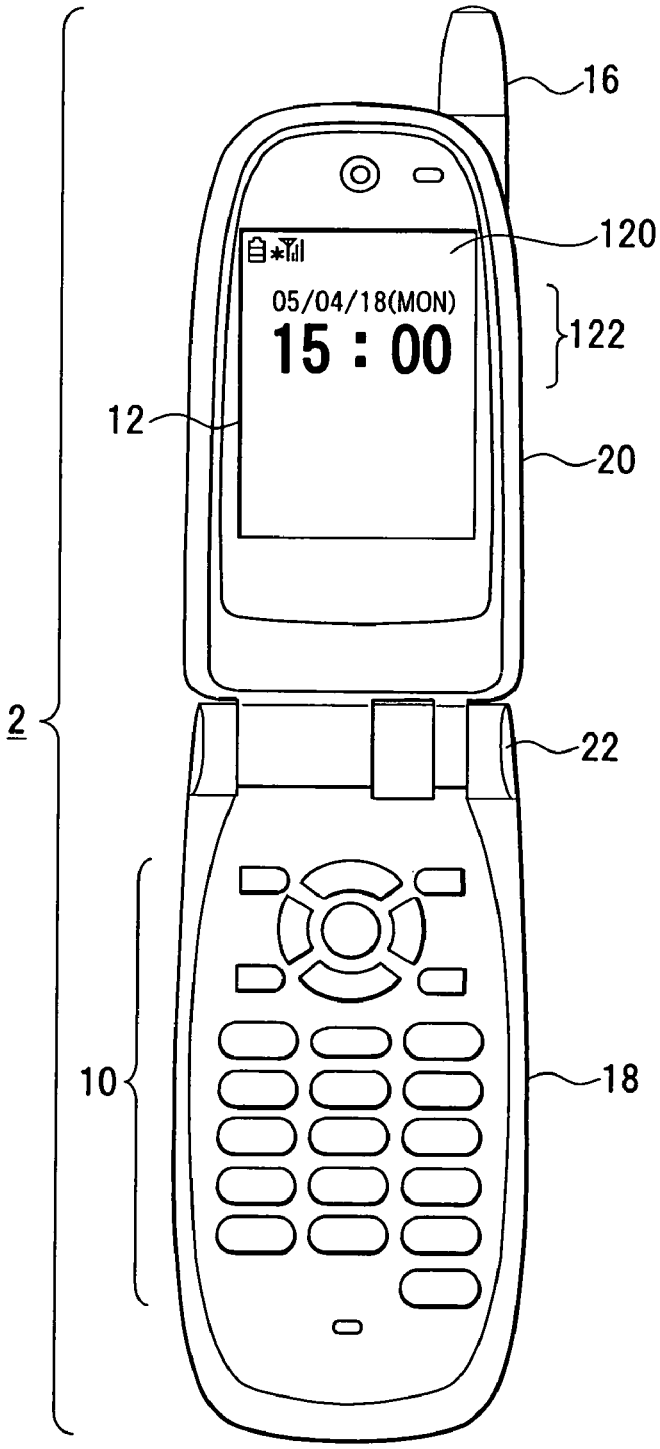
FIG. 2 is a diagram showing a configuration example of the appearance of a mobile terminal device.

A first embodiment of the present invention will be described with reference to FIGS. 1 and 2. FIG. 1 is a block diagram of a mobile terminal device according to a first embodiment, and FIG. 2 is a diagram showing its appearance.

This mobile terminal device 2 is one example of an electronic device such as mobile phones that can receive various types of information such as a time correction information transmitted by radio waves. And the mobile terminal device 2 of this embodiment includes a function to correct its internal time automatically with a time correction information supplied from outside such as base stations or a network. Here, the internal time indicates the time that functions inside the mobile terminal device 2 or the time that is displayed.

This mobile terminal device 2 includes a memory section 4, a processor 6, a wireless reception section 8, an input operation section 10, a display section 12, a timer 14 and others. The memory section 4 represents a ROM (Read-Only Memory), a RAM (Random-Access Memory), or the like as a whole, and can be comprised of removable storage medium. In this memory section 4, a program storage area 42, a data storage area 44 and the like are provided.

This program storage area 42 stores a management program 420, a time management program 421, and a time correction program 422, along with various types of application programs that use time information such as an image display program 423, a schedule program 424, a calendar/date and time program 425, an alarm clock program 426, a shot image storage program 427, a history information storage program 428, a software update program 429, and so on.

The management program 420 constitutes a framework and manages the above-described programs such as the time management program 421, the time correction program 422, the image display program 423, the schedule program 424; and also manages time correction by judging whether a time correction can be performed, that is, whether any correction inhibiting periods is applicable or not, and then either supplies the time correction information to each program, or discards the time correction information. The time management program 421 measures time and outputs its display information. The time correction program 422 is a program that corrects internal time of the device by using the time correction information supplied from outside. The image display program 423 is a program that displays on the display section 12 such as time, operation screen of each program in progress, icons, cursor, and messages from the input operation section 10 for prompting input of information or the like. Time information is referenced by the schedule program 424; the calendar/date and time program 425; the alarm clock program 426; the shot image storage program 427; the history information storage program 428; the software update program 429; and other application programs, and a time correction information is used for correcting the time.

In the data storage area 44, a schedule storage area 441; a shot image storage area 442; a history information storage area 443; a mail storage area 444 and the like, which store various types of information pertaining to time information are provided. Time information of events or the like is stored into these areas along with each event information.

The processor 6 constitutes a control section and a time correction section. The processor 6 is comprised of a CPU (Central Processing Unit) or the like, and includes a memory section (retention section) as well for holding the date in progress. This processor 6 executes various types of programs such as the above-described management program 420 in such a way that time data is generated; internal time of the device is corrected with the use of a time correction information; and the time information is retained.

The wireless reception section 8 receives wireless signals from the base stations and the network via an antenna 16, reproduces the supplied time correction information, and adds to the processor 6. The input operation section 10 is used for correcting internal time of the device manually and the like.

The display section 12 consists of an LCD (Liquid Crystal Display), for example. On this display section 12, time that is outputted from the processor 6 is displayed along with characters, graphics, shot images and others. This time display includes not only the present time, but also the time associated with the information that is displayed when various types of programs are executed.

The timer 14 consists of a clock generation circuit or the like and generates a clock signal. This clock signal is used in the operation of the processor 6.

This mobile terminal device 2 is configured to be openable/closable such that a first and a second case parts 18, 20 are connected via a hinge part 22, as shown in FIG. 2. On the case part 18, the input operation section 10 including multiple keys is disposed; and on the case part 20, the display section 12 as well as the antenna 16 is disposed. On a screen 120 of the display section 12, a current date and time 122 is displayed as the device side time of before or after time correction.

Figure 3:
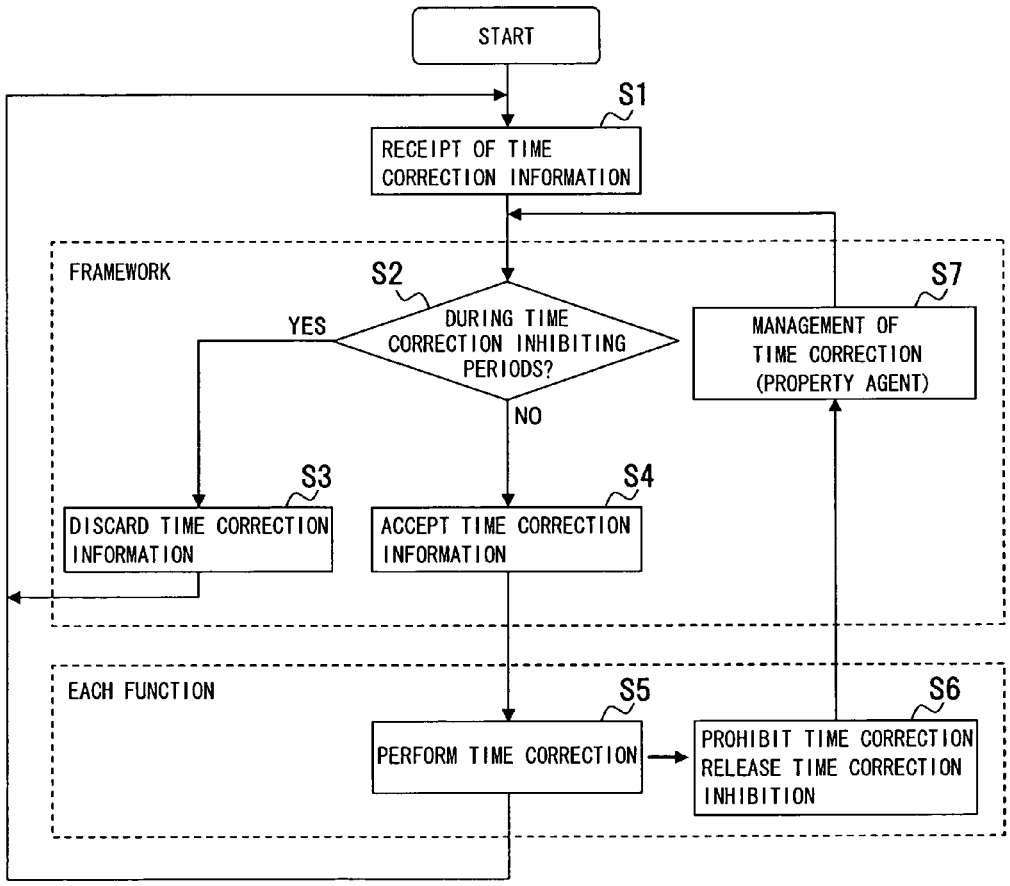
FIG. 3 is a flowchart showing the processing of time correction, time correction inhibition, and release of the inhibition.

Next, the processing of time correction, time correction inhibition, and release of the inhibition in this mobile terminal device 2 will be described with reference to FIG. 3. FIG. 3 is a flowchart showing the processing of time correction, time correction inhibition, and release of the inhibition.

When the mobile terminal device 2 receives a time correction information from the base stations or the network (step S1), the management program 420 constituting the framework is executed and a judgment is made whether any correction inhibiting periods is applicable or not (step S2). This "any correction inhibiting periods" means one or plural periods selected from the following time correction inhibiting periods.

(1) A certain period after power-on (T1);

(2) A period while a time correction is in progress, the period for preventing repetition of correction by another time correction information that is supplied during the processing of time correction (T2) (=a certain period during which the processing of time correction is prohibited in order to prevent a repeat of correction)

(3) A certain period after the processing of time correction is completed (T3);

(4) A certain period that can be set arbitrary other than these (1) through (3) (T4).

During this time correction inhibiting periods, the received time correction information is discarded (step S3) and the procedure returns to step S1. If not during the time correction inhibiting periods, then the received time correction information is supplied to the time correction program 422 (each function), and a time correction is performed by the management program 421 or the like (step S5), and then the procedure returns to step S1.

When the processing of time correction is performed (step S5), a notification of time correction inhibition is issued and later on a notification of releasing the time correction inhibition is issued from the ongoing programs at the completion of the time correction (step S6); a property agent that manages the time correction, i.e., the management program 420 receives the notification (step S7). In order to secure the current time correction, the time correction inhibition is set, and later on released at the completion of the time correction. Its specific processing is described in detail in FIG. 4 through FIG. 11(B).

Figure 4:
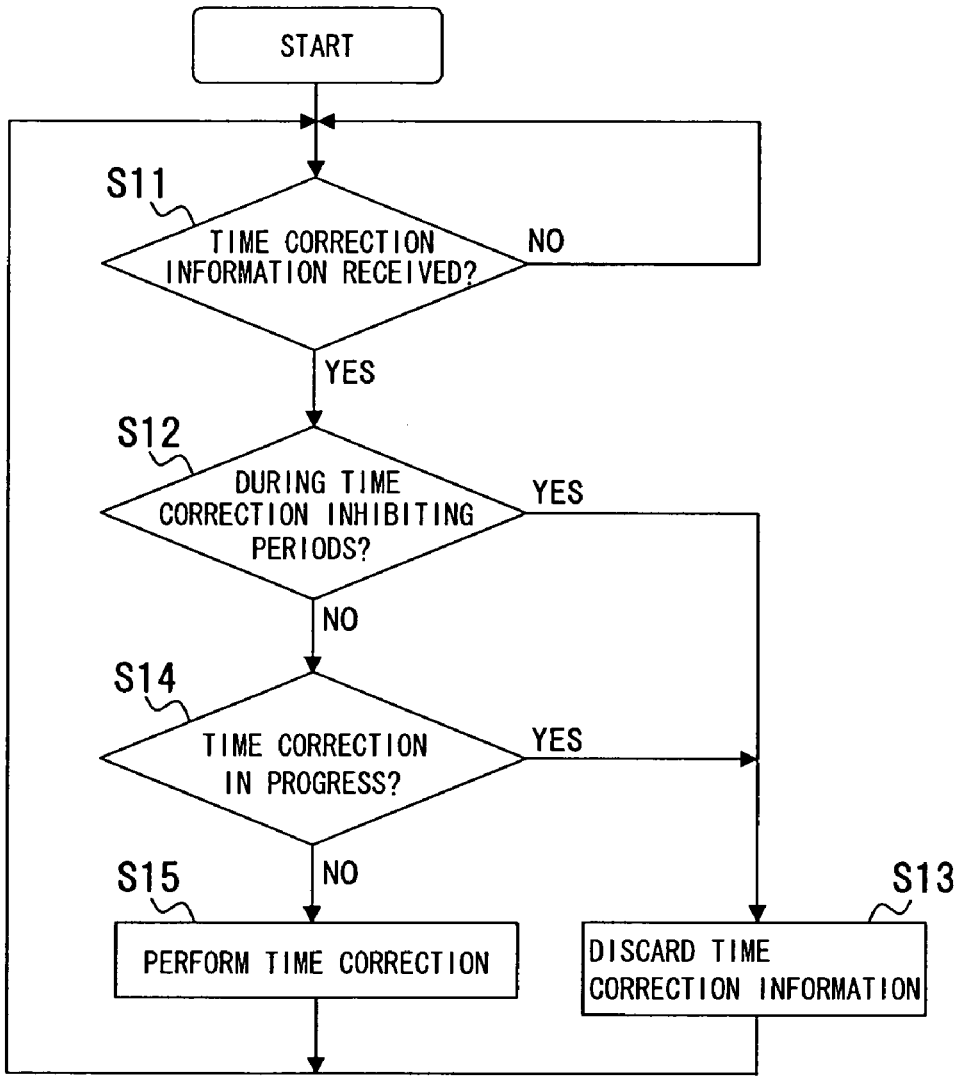
FIG. 4 is a flowchart showing the processing of time correction.

Next, the processing of time correction in this mobile terminal device 2 will be described with reference to FIG. 4. FIG. 4 is a flowchart showing the processing of time correction.

This mobile terminal device 2 monitors whether a time correction information supplied from the base stations or the network is received or not (step S11); and if it is received, then a judgment is made whether or not any of the time correction inhibiting periods T1 (FIG. 5), T2 (FIG. 6), T3 (FIG. 7), or T4 (FIG. 8) is applicable to the received time correction information (step S12); and if applicable, then the received time correction information is discarded (step S13). Or, if not applicable, then another judgment is made whether or not a time correction is currently taking place (step S14); if it is, then the received time correction information is discarded (step S13), and if not, then the processing of time correction is performed (step S15).

In this way, setting the time correction inhibiting periods T1 to T4 provides a way to prevent time corrections from taking place randomly with a time correction information supplied periodically or unperiodically, and to enable a time correction performed appropriately at the right time. In addition, owing to step S14 in this processing, wrong corrections can be prevented that might occur in the case where another time correction information is received while performing a time correction to which none of the time correction inhibiting periods was applicable (step S12).

Figure 5:
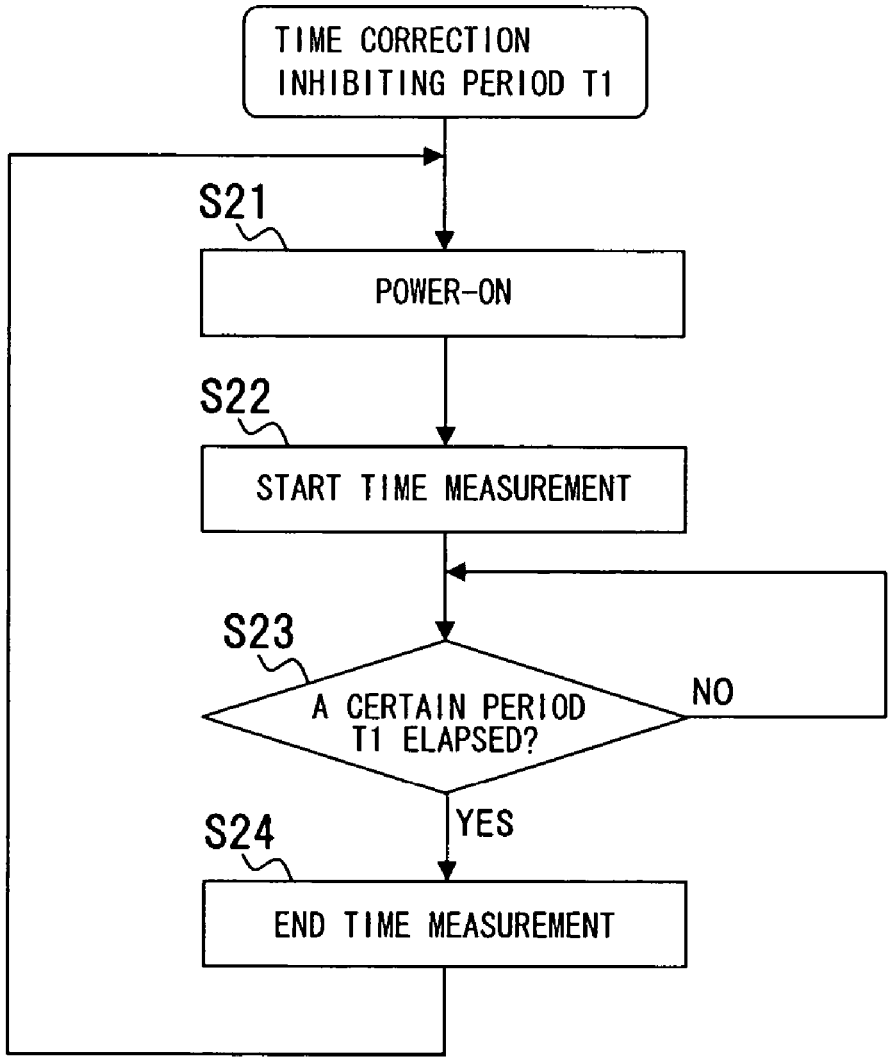
Figure 6:
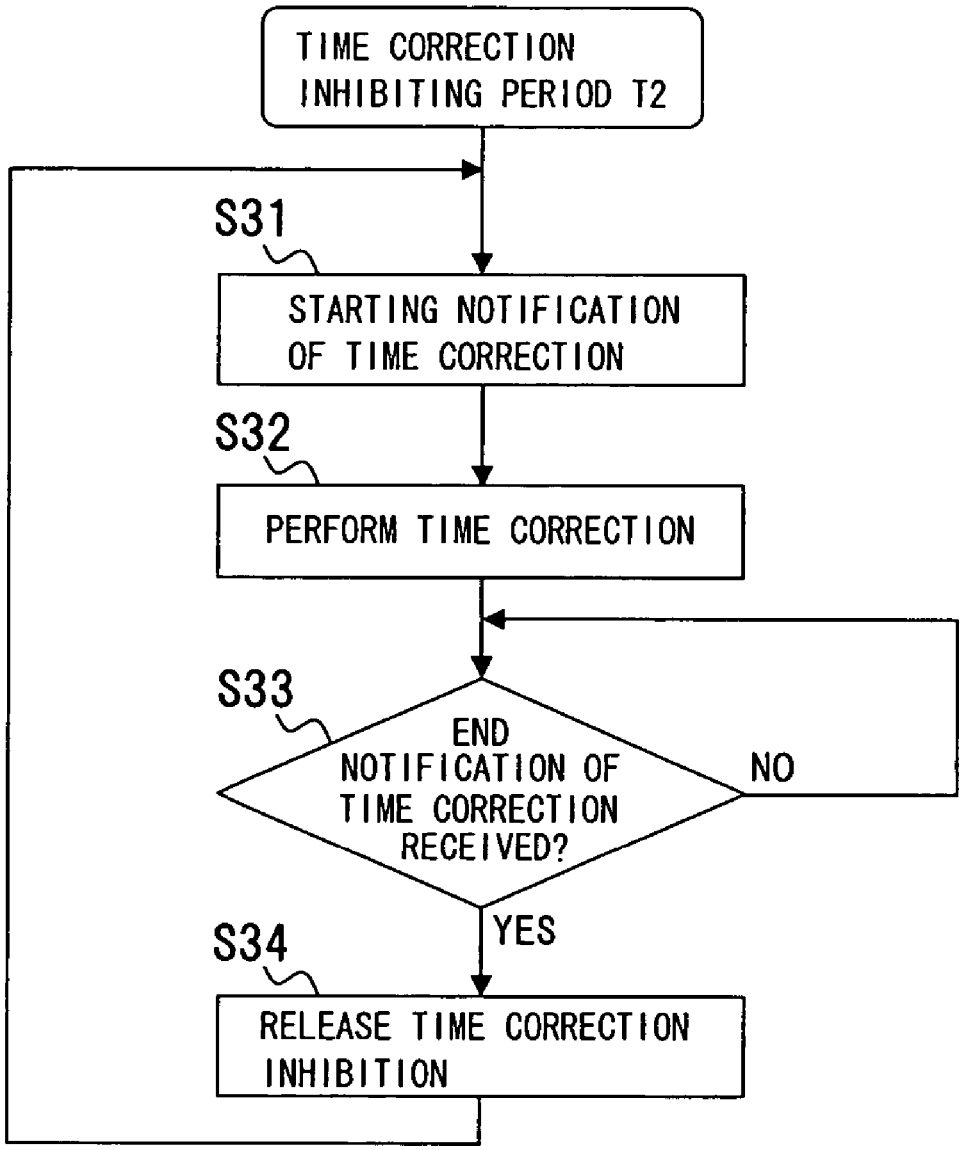
FIG. 6 is a flowchart showing the setting of T2, a time correction inhibiting period while a time correction is in progress.
Figure 7:
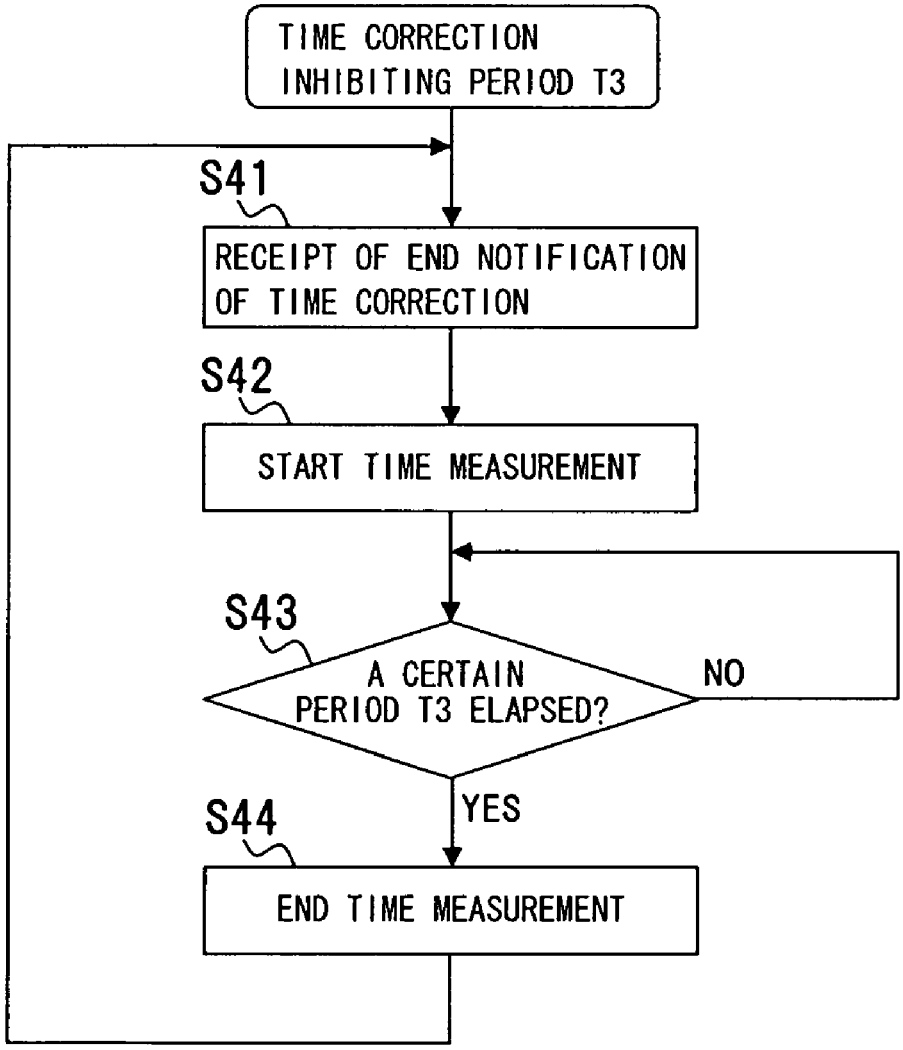
FIG. 7 is a flowchart showing the setting of T3, a time correction inhibiting period after a time correction is completed.
Figure 8:
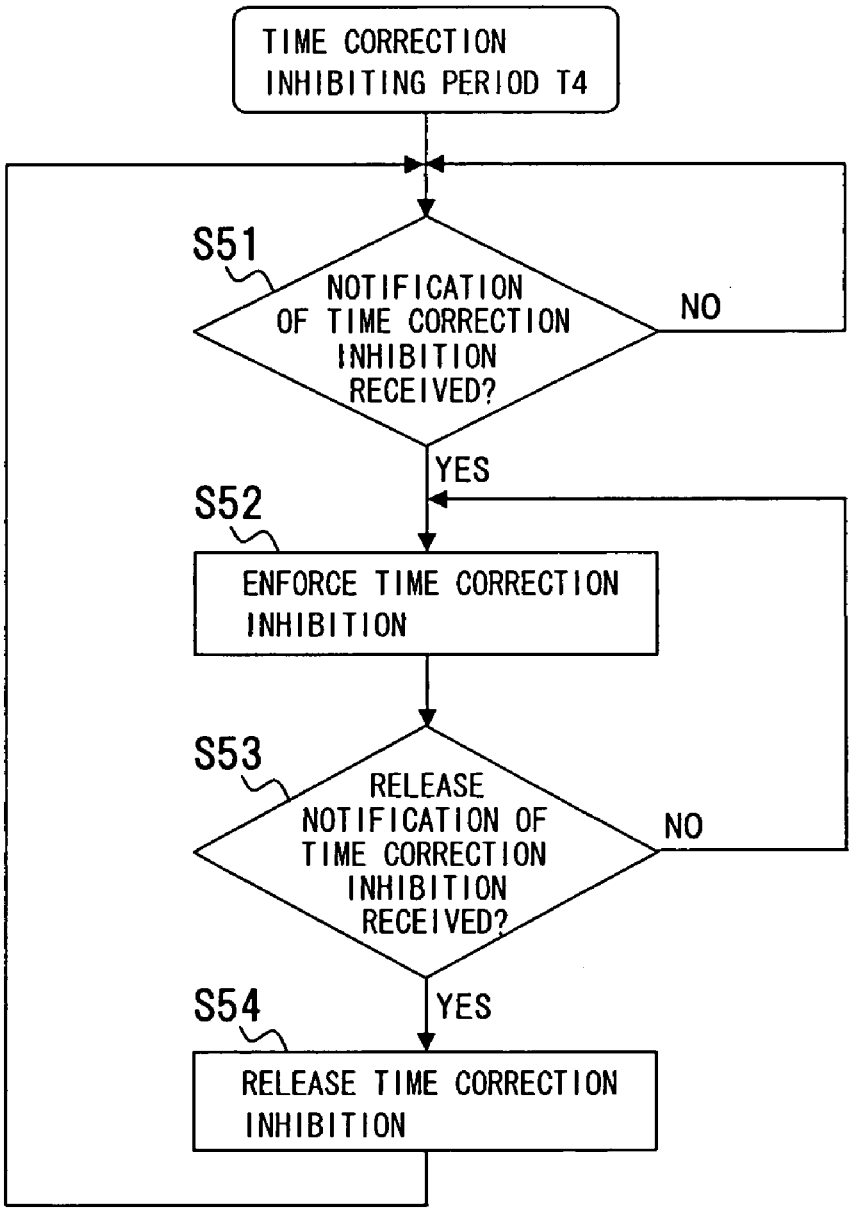
FIG. 8 is a flowchart showing the setting of T4, a time correction inhibiting period that can be set arbitrarily.

Next, settings of the time correction inhibiting periods T1, T2, T3, and T4 will be described with reference to FIGS. 5, 6, 7, and 8. FIG. 5 is a flowchart showing the setting of T1, a time correction inhibiting period after power-on; FIG. 6 is a flowchart showing the setting of T2, a time correction inhibiting period while a time correction is in progress; FIG. 7 is a flowchart showing the setting of T3, a time correction inhibiting period after the time correction is completed; and FIG. 8 is a flowchart showing the setting of T4, a time correction inhibiting period that can be set arbitrarily.

As shown in FIG. 5, when the power is turned on (step S21), measurement of time starts (step S22), and after a certain period T1 (step S23), the measurement ends (step S24). The time correction inhibiting period T1 is set after the predetermined time has elapsed since the power-on.

Such a time correction inhibiting period T1 can prevent time correction from occurring in an unstable state immediately after power-on.

Further, as shown in FIG. 6, upon receipt of a starting notification of time correction (step S31), the processing of time correction starts (step S32). Thereafter, through the monitoring that whether or not an end notification of the time correction is received (step S33), and upon its receipt, time correction inhibition is released (step S34). A certain period T2 that is between the instant when the starting notification of time correction is received and the instant when the end notification thereof is received becomes the time correction inhibiting period T2.

Setting such a time correction inhibiting period T2 can prevent accepting another time correction information while a time correction is in progress, and can avoid confusion in time correction. Thus, reliability of time correction can be ensured.

Further, as shown in FIG. 7, at the completion of the time correction, its end notification is received (step S41); measurement of time starts upon receipt of the notification (step S42); and the monitoring continues until a certain period T3 has elapsed (step S43). The time measurement ends after a certain period T3 has elapsed (step S44). In this way, the time correction inhibiting period T3 is set.

Setting such a time correction inhibiting period T3 can prevent time correction from repeating immediately after a time correction is performed, and can avoid repetition of time correction. That is, since next time correction is performed by a time correction notification issued from applications, time correction can be performed appropriately.

Further, as shown in FIG. 8, a notification of the time correction inhibition is monitored (step S51), and if it is received, then the time correction inhibition is maintained (step S52). A notification of releasing the time correction inhibition is monitored (step S53), and if it is received, then the time correction inhibition is released (step S54). A certain period T4 that is between the instant when a starting notification of this time correction inhibition is received and the instant when a release notification thereof is received becomes the time correction inhibiting period T4.

Setting such a time correction inhibiting period T4 can provide inhibition of time correction operations that may occur randomly while performing a time correction, and can prevent confusion in the operations of programs caused by the supplied time correction information.

In this way, by setting these time correction inhibiting periods T1 (a certain period after the power-on), T2 (a certain period during a time correction operation), T3 (a certain period after the time correction operation), and T4 (a certain period that can be set arbitrary); a time span is set in each of the cases, i.e., after the power-on, during a time correction operation, and after the time correction operation, during which no time correction information is accepted until the next time correction becomes available. These time correction inhibiting periods T1 through T4 are set by the management program 420 that constitutes the framework, which is the upper function of each application program.

Specifically, the time correction inhibiting period T1 always arises with the power-on; T2 and T3 arise successively after certain periods since a time correction has performed, and during these periods, even though a time correction information is notified from the network, it is discarded.

Further, the time correction inhibiting period T4 is set separately in the application side as a period during which acceptance of time correction should be avoided. That is, time correction inhibition is notified to the management program 420 that constitutes the framework, which is the upper function of applications, and upon the receipt of the notification, time correction inhibition is set for a certain period T4. In this case, after the request of setting time correction inhibition has been made to the management program 420 that constitutes the framework, the time correction inhibition continues until its release is notified from the application side. Therefore, even though a time correction information is notified from the network, it is discarded.

Figure 9:
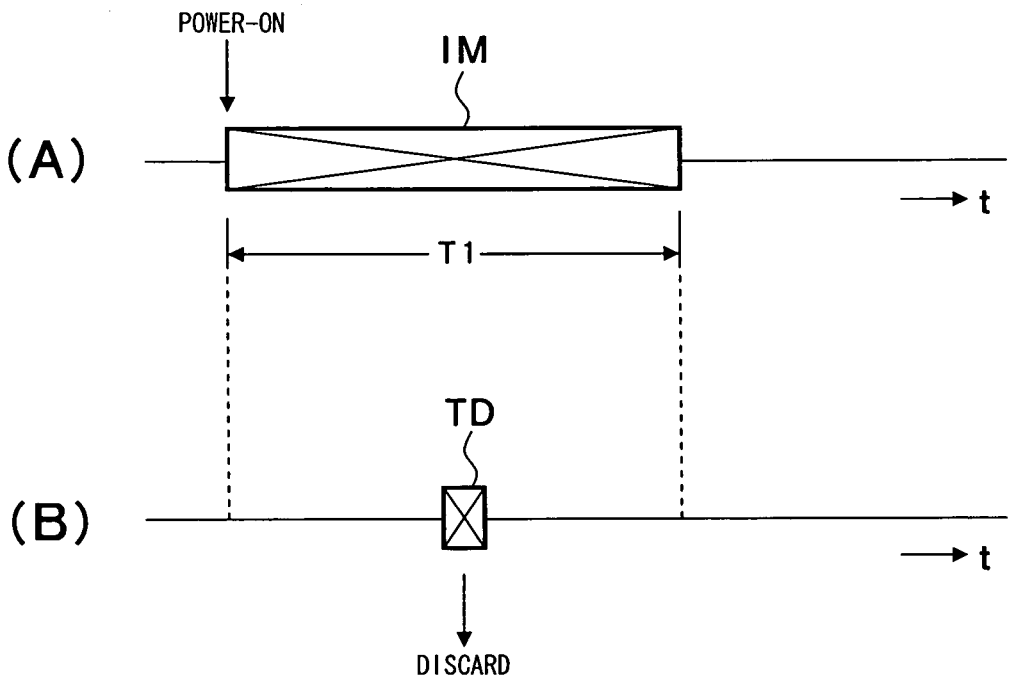
Figure 10:
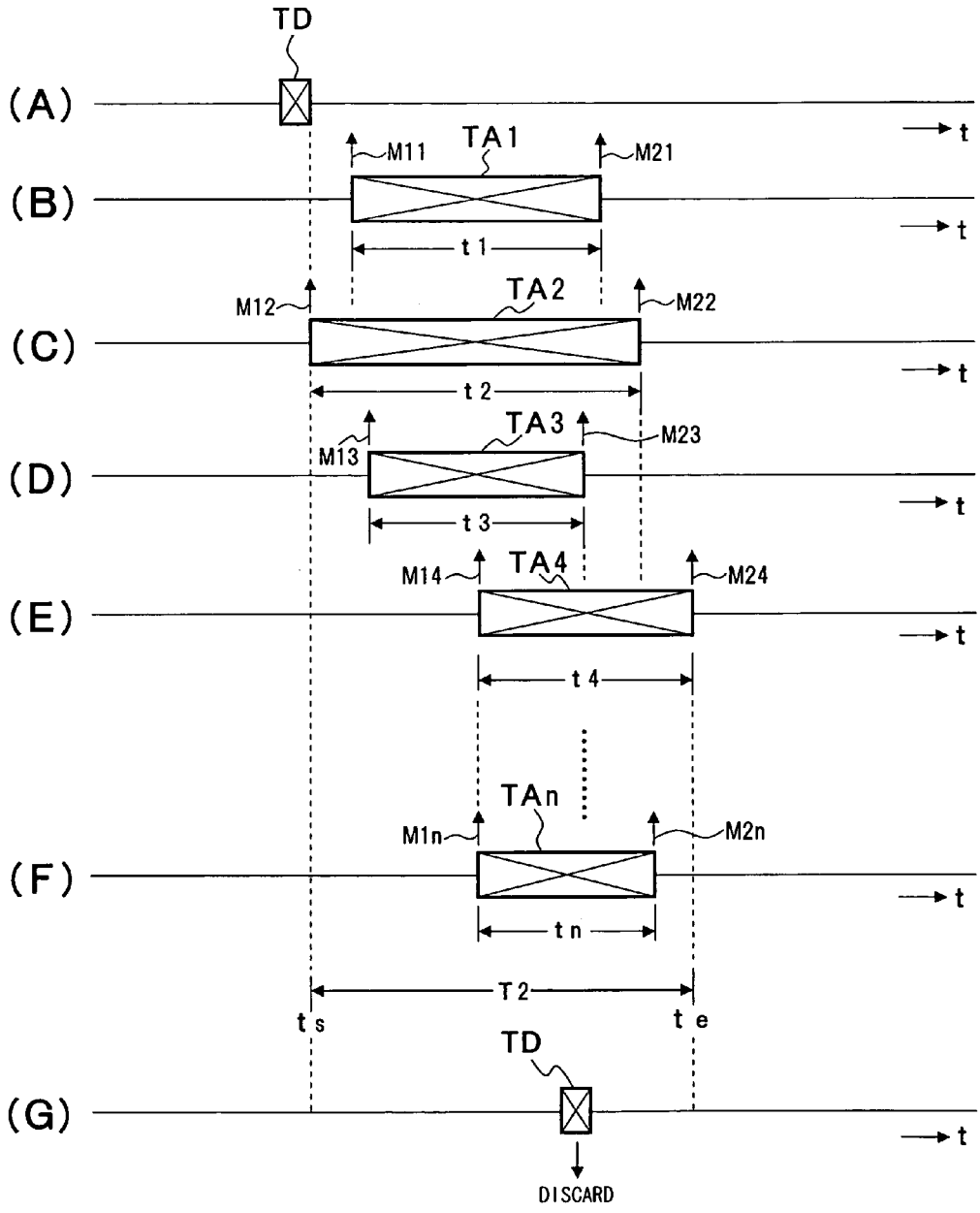
FIGS. 10(A) to 10(G) are diagrams showing a time correction inhibiting period T2 generating while a time correction is in progress.
Figure 11:
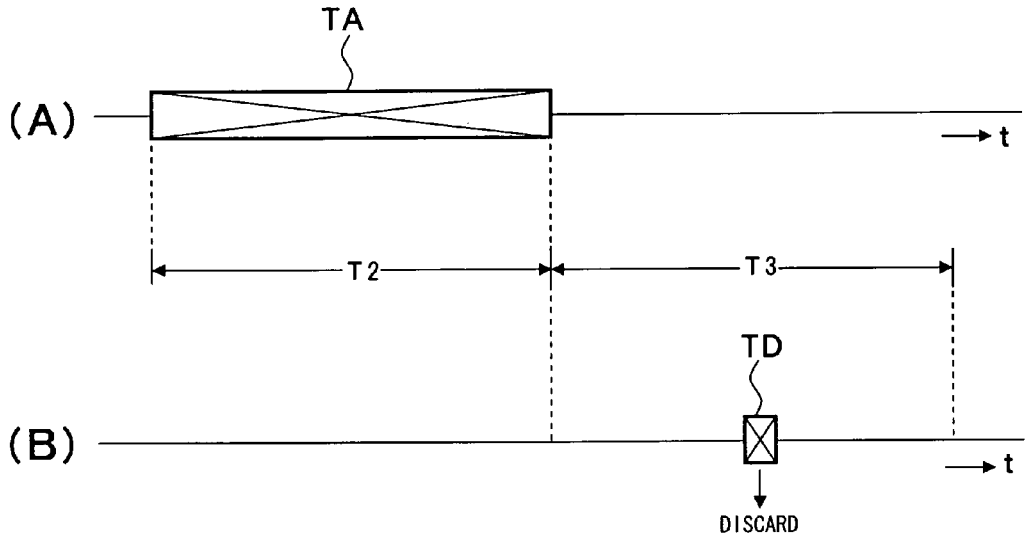
FIGS. 11(A), 11(B) are diagrams showing a time correction inhibiting period T3 generating immediately after a time correction is finished.
Figure 12:
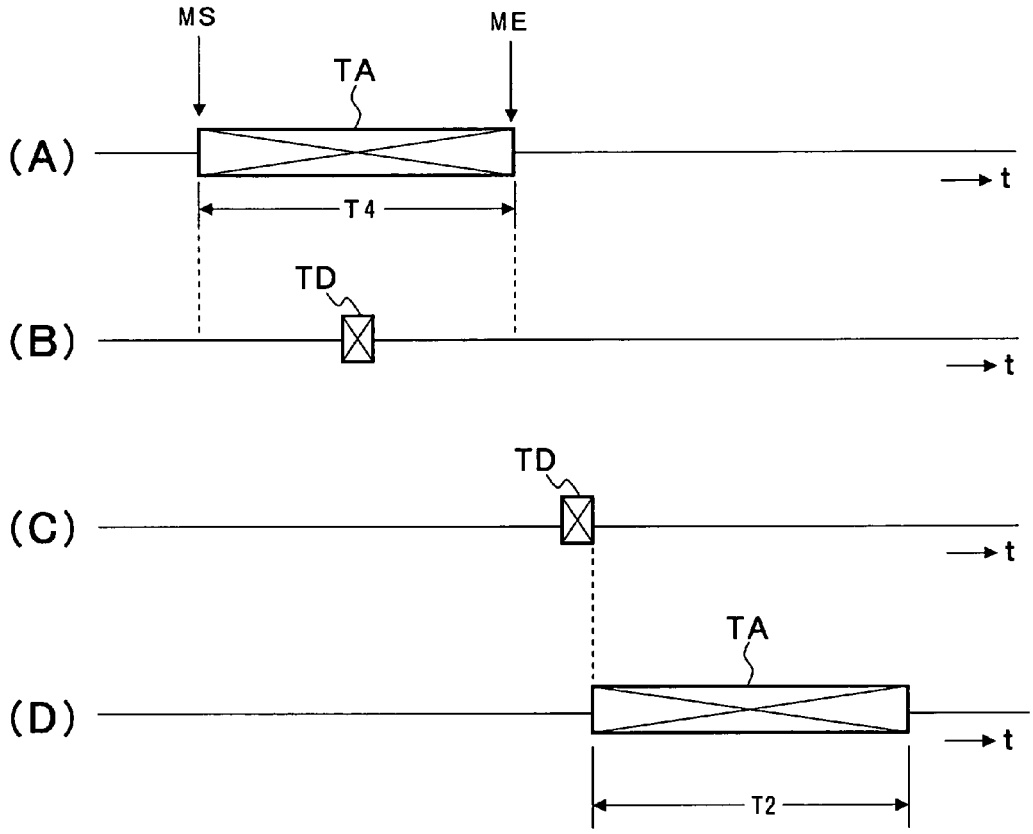
FIGS. 12(A) to 12(D) are diagrams showing a time correction inhibiting period T4 generating arbitrary.

Next, generation of each of the time correction inhibiting periods will be described with reference to FIGS. 9(A) to 12(D). FIGS. 9(A), 9(B) are diagrams showing the time correction inhibiting period T1 generating immediately after the power-on; FIGS. 10(A) to 10(G) are diagrams showing the time correction inhibiting period T2 generating while a time correction is in progress; FIGS. 11(A), 11(B) are diagrams showing the time correction inhibiting period T3 generating immediately after the time correction is finished; and FIGS.

12(A) to 12(D) are diagrams showing the time correction inhibiting period T4 generating arbitrary.

As shown in FIG. 9(A), an initial setting operation IM is performed during a certain period T1 after the power-on, and this T1 becomes the time correction inhibiting period T1. Therefore, as shown in FIG. 9(B), even though a time correction information TD is supplied during this time correction inhibiting period T1, this TD cannot be accepted and discarded.

Further, as shown in FIG. 10(A), the time correction information TD is supplied and time correction operation is performed with this TD, then as shown in FIGS. 10(B), 10(C), 10(D), 10(E), and 10(F), with the receipt of TD, the time correction processing TA1, TA2, TA3, TA4, . . . TAn are performed. These time correction processing TA1 to TAn are separate processing performed by applications such as the previously described time management program 421. When these time correction processing TA1 to TAn are started, then the processor 6 executing the management program 420 monitors starting notifications of time corrections M11, M12, M13, M1*n* and end notifications of time corrections M21, M22, M23, . . . M2*n*, which are generated from each processing TA1 to TAn. In this embodiment, a time span between M12 that is the first staring notification of time correction and M24 that is the last end notification of time correction, i.e., the time span T2 that is between the time ts and the time te corresponds to the period of time correction processing, which becomes the time correction inhibiting period T2. During this period T2, as shown in FIG. 10(G), even though the time correction information TD is supplied, this TD cannot be accepted and discarded.

Further, as shown in FIG. 11(A), a certain period T3 is set immediately after a time correction processing TA is completed (time correction processing TA1, TA2, TA3, . . . TAn in FIGS. 10(A) to 10(G)), and this T3 becomes the time correction inhibiting period T3 that arises immediately after the time correction has completed.

As shown in FIG. 11(B), during this time correction inhibiting period T3, even though the time correction information TD is supplied, this TD can not be accepted and discarded.

Furthermore, as shown in FIG. 12(A), when a time correction inhibiting notification MS is issued from any application programs, then a processing TA pertaining to time information is performed in the program, and at the completion of the processing, a ME that is a release notification of the time correction inhibition is issued. A time span T4 between the MS that is a notification of time correction inhibition and the ME that is a release notification of the time correction inhibition corresponds to the time correction inhibiting period T4. During this period T4, as shown in FIG. 12(B), even though the time correction information TD is supplied, this TD cannot be accepted and discarded.

Then after this time correction inhibiting period T4, as shown in FIG. 12(C), when the time correction information TD is supplied, then the time correction processing TA is performed with the TD. This processing time T2 becomes the time correction inhibiting period T2.

After this time correction inhibiting period T4 has elapsed, as described above (FIG. 11(A)), the time correction inhibiting period T3 may be set.

With the setting of one, plurality, or all of the time periods selected from the above-described time correction inhibiting periods T1 to T4, the time correction information TD is accepted and then a time correction is performed by using the time correction information TD, so that the device side time can be corrected appropriately and confusion caused by repeated corrections while a time correction is in progress or the like never arise.

Second Embodiment

Figure 13:
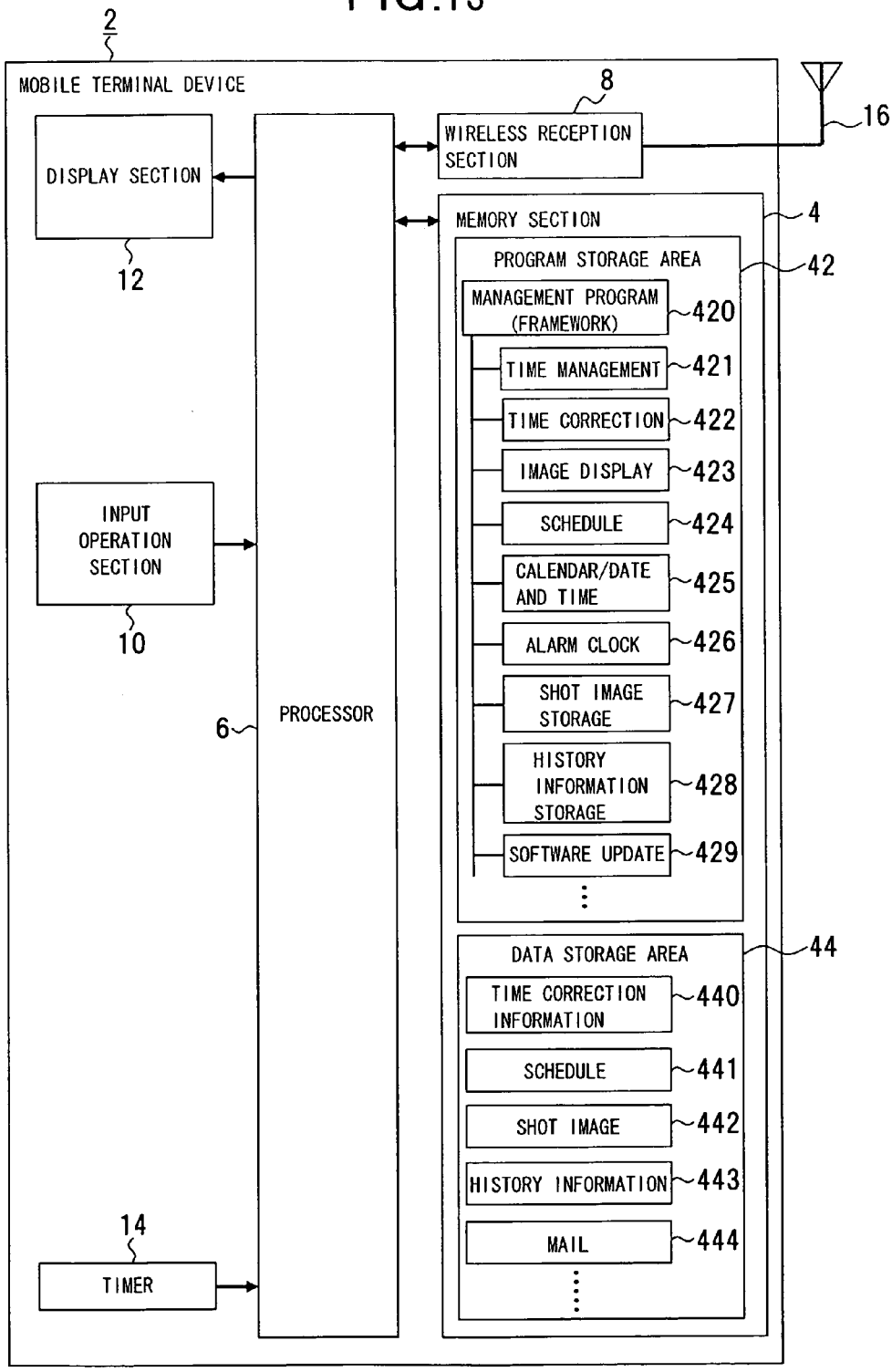
FIG. 13 is a block diagram showing a mobile terminal device according to a second embodiment.

Next, a second embodiment of the present invention will be described with reference to FIG. 13. FIG. 13 is a block diagram showing a mobile terminal device 2 according to a second embodiment. In FIG. 13, the same symbols are assigned to parts identical to those of the mobile terminal 2 in FIG. 1.

In the mobile terminal device 2 of this embodiment, a time correction information storage area 440 is provided in the date storage area 44, and the time correction information TD that is received through the wireless reception section 8 is stored. That is, in the first embodiment, the time correction information TD that was received during the time correction inhibiting periods T1 to T4 was discarded. However in this embodiment, a configuration is used in which the time correction information TD is stored into the time correction information storage area 440 in the date storage area 44; and in order to perform the time correction later at the right time, a time span ΔT is calculated (from the instant when the information TD is received until the instant when the time correction is performed) to adjust the time correction information TD. Other configurations are the same as those of the first embodiment.

Figure 14:
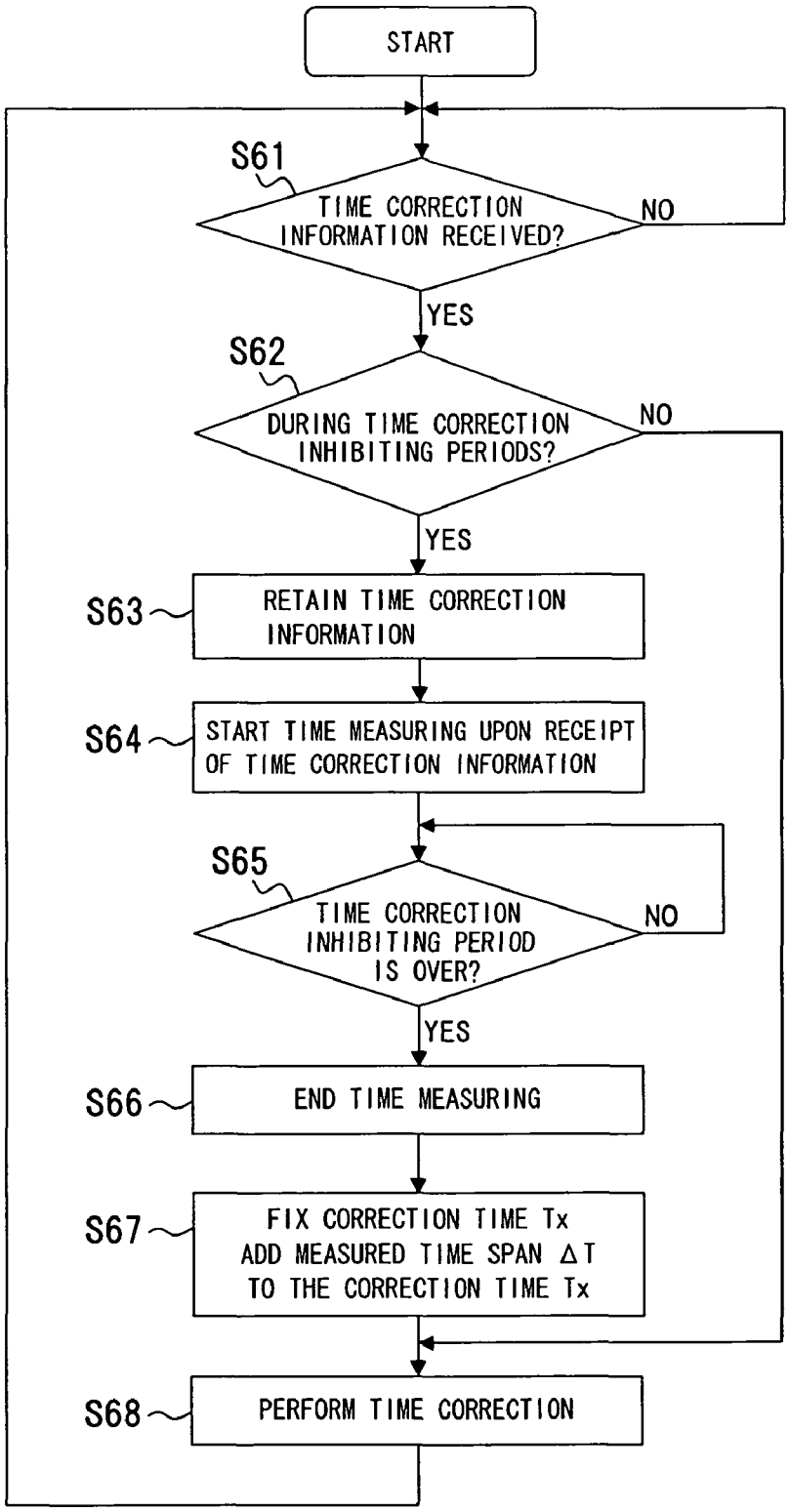
FIG. 14 is a flowchart showing the processing of a time correction.

Next, time correction inhibition and time correction will be described with reference to FIG. 14. FIG. 14 is a flowchart showing the processing of time correction.

It is supposed that the mobile terminal device 2 is maintained in an operational state. When the time correction information TD is received (step S61), a judgment is made whether any of the time correction inhibiting-periods T1 (FIG. 5), T2 (FIG. 6), T3 (FIG. 7), or T4 (FIG. 8) is applicable or not; and if none of T1 to T4 is applicable, then a time correction (step S68) is performed; or if any of T1 to T4 is applicable, then the time correction information TD is stored into the time correction information storage area 440 and retained.

Then, time measurement starts at the instant when the time correction information TD is received (step S64); monitoring starts to watch whether or not any of the time correction inhibiting periods is finished (step S65); the time measurement finishes at the completion of the time correction inhibiting period (step S66); and a time span ΔT is obtained by counting from the beginning of the measurement to the end of the measurement. Then by executing the time correction program 422, a correction time Tx is fixed with the use of the time span ΔT (step S67). The correction time Tx is fixed to become a true time Ty (time to be fixed) by adding the time span ΔT thereto. Thus, the fixed true time Ty is obtained as follows.

$$Ty=Tx+\Delta T \quad (1)$$

Time correction is performed with the use of this true time Ty (step S68).

Figure 15:
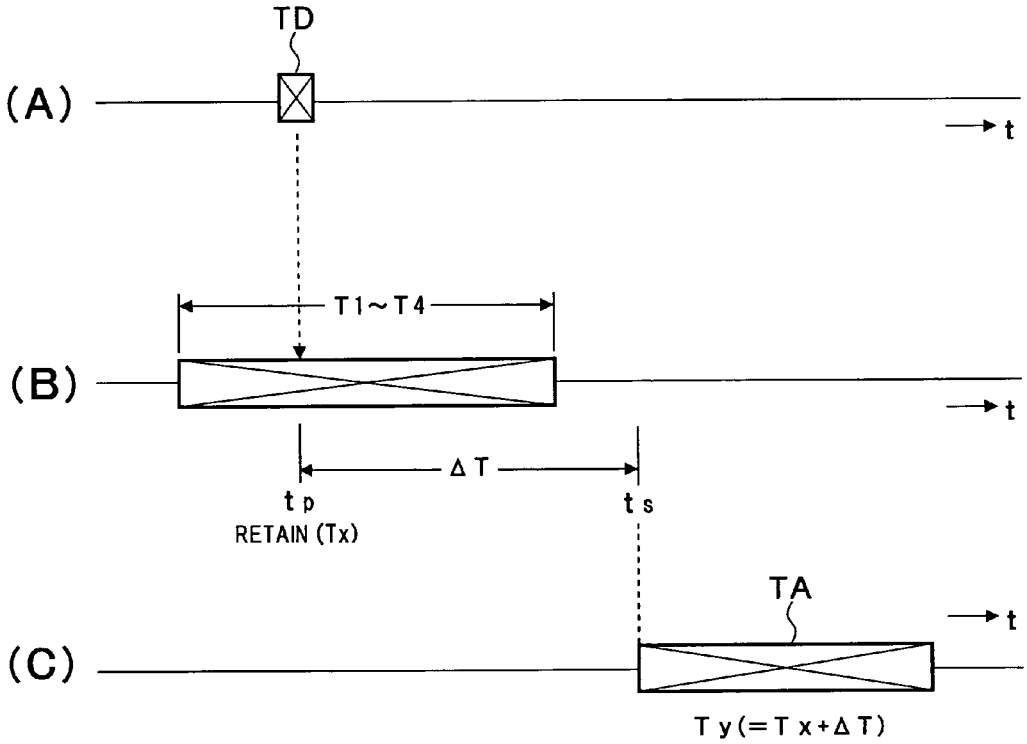
FIGS. 15(A), 15(B), and 15(C) are diagrams showing the timing at which a time correction is performed when a time correction information is retained.

Next, the way a time correction is performed will be described with reference to FIGS. 15(A), 15 (B), and 15(C). FIGS. 15(A) to 15(C) are diagrams showing the timing at which a time correction is performed with the use of retained time correction information.

As shown in FIG. 15(A), when the time correction information TD is supplied, then as shown in FIG. 15(B), the information TD will be retained even though it is received during any of the time correction inhibiting periods T1 to T4; and time measurement starts at the time point tp (the instant when the time correction information TD is received and retained) and continues until the time point ts (the instant when the time correction starts); and thus a time span ΔT is counted between tp and ts. Then, as shown in FIG. 15(C), the time correction processing TA adds the time span ΔT to the correction time Tx supplied from the time correction information TD to produce a true time Ty, and with this true time Ty, the time correction is performed.

Third Embodiment

Figure 16:
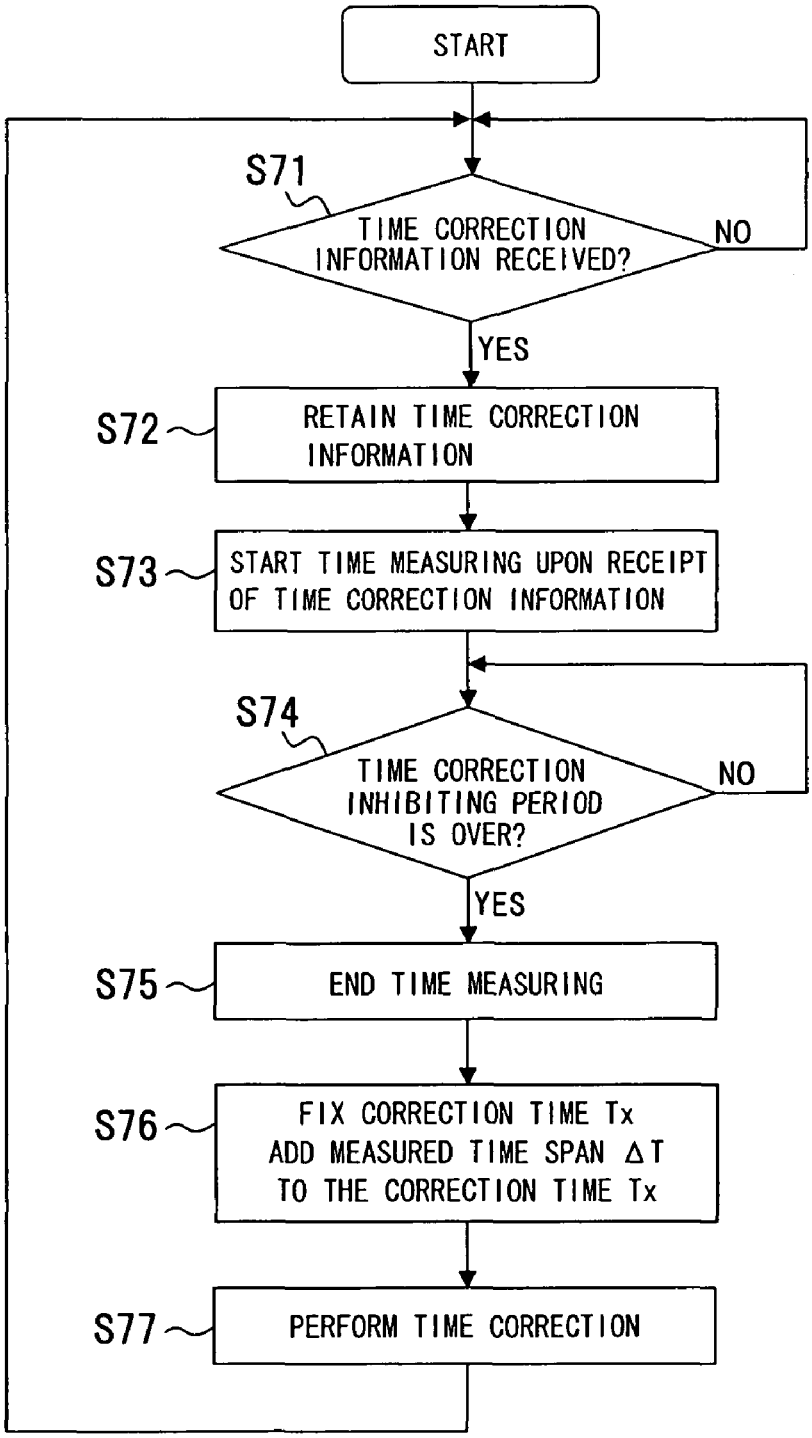
FIG. 16 is a flowchart showing the processing of time correction inhibition and a time correction according to a third embodiment.

Next, a third embodiment of the present invention will be described with reference to FIG. 16. FIG. 16 is a flowchart showing the processing of time correction inhibition and time correction according to a third embodiment.

In the processing shown in FIG. 14 and FIGS. 15(A) to 15(C), a configuration is used in which depending on when the time correction information TD is supplied, either the time correction is performed with the use of the time correction information TD; or the information TD is retained if it is received during the time correction inhibiting periods T1 to T4. In contrast to this, in the processing shown in FIG. 16, the supplied time correction information TD is retained regardless whether it is received during the time correction inhibiting periods T1 to T4 or not.

When the time correction information TD is received (step S71), the information TD is stored into the time correction information storage area 440 and retained (step S72).

Then, time measurement starts at the instant when the time correction information TD is received (step S73); the time correction inhibition is monitored (step S74); the time measurement finishes at the completion of the time correction inhibition (step S75); and the time span ΔT is obtained by counting from the beginning of the measurement to the end of the measurement. By executing the time correction program 422, the correction time Tx is fixed with the use of the time span ΔT (step S76). By adding the time span ΔT to the supplied correction time Tx, the correction time Tx is fixed to the true time Ty (time to be fixed). The way to obtain this Ty has been shown in the above equation (1). By using this true time Ty, the time correction is performed (step S77).

According to this configuration, the true time Ty is obtained by adding the time span ΔT (from the receipt of the time correction information TD until the starting point of the time correction) to the correction time Tx; and the time correction is performed with this time Ty, so that time correction can be performed appropriately and accuracy of the device side time can be enhanced.

Figure 17:
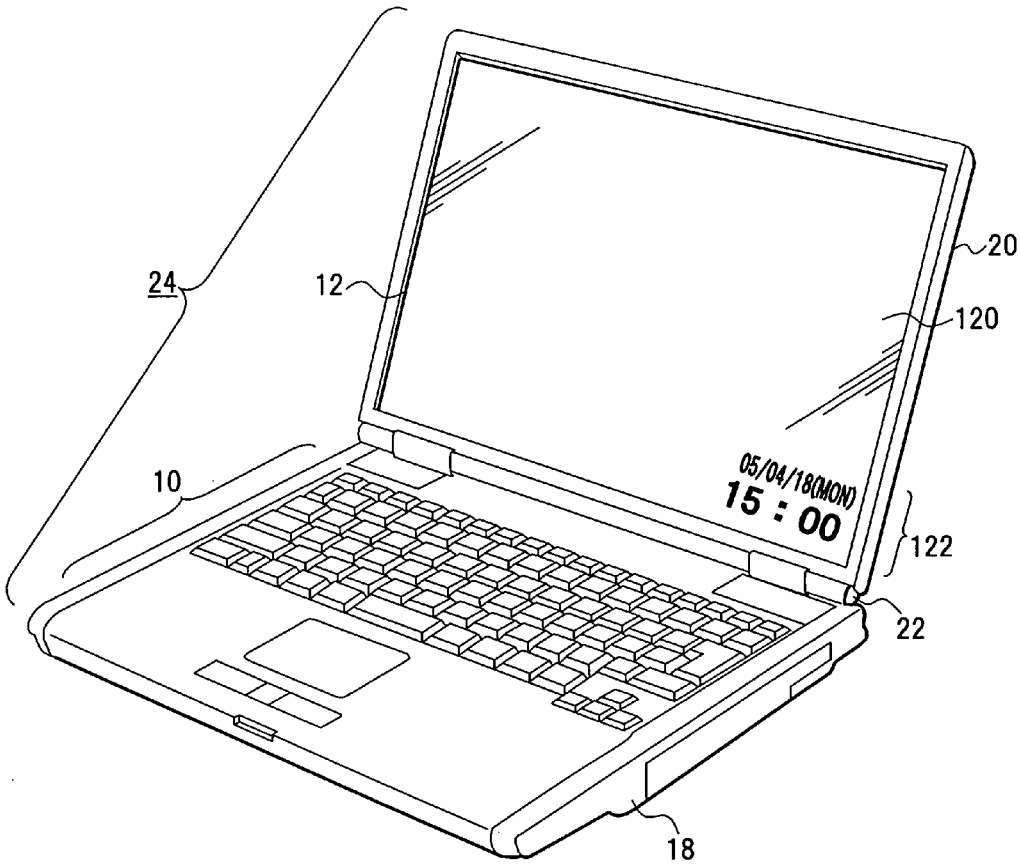
FIG. 17 is a perspective view of a PC.
Figure 18:
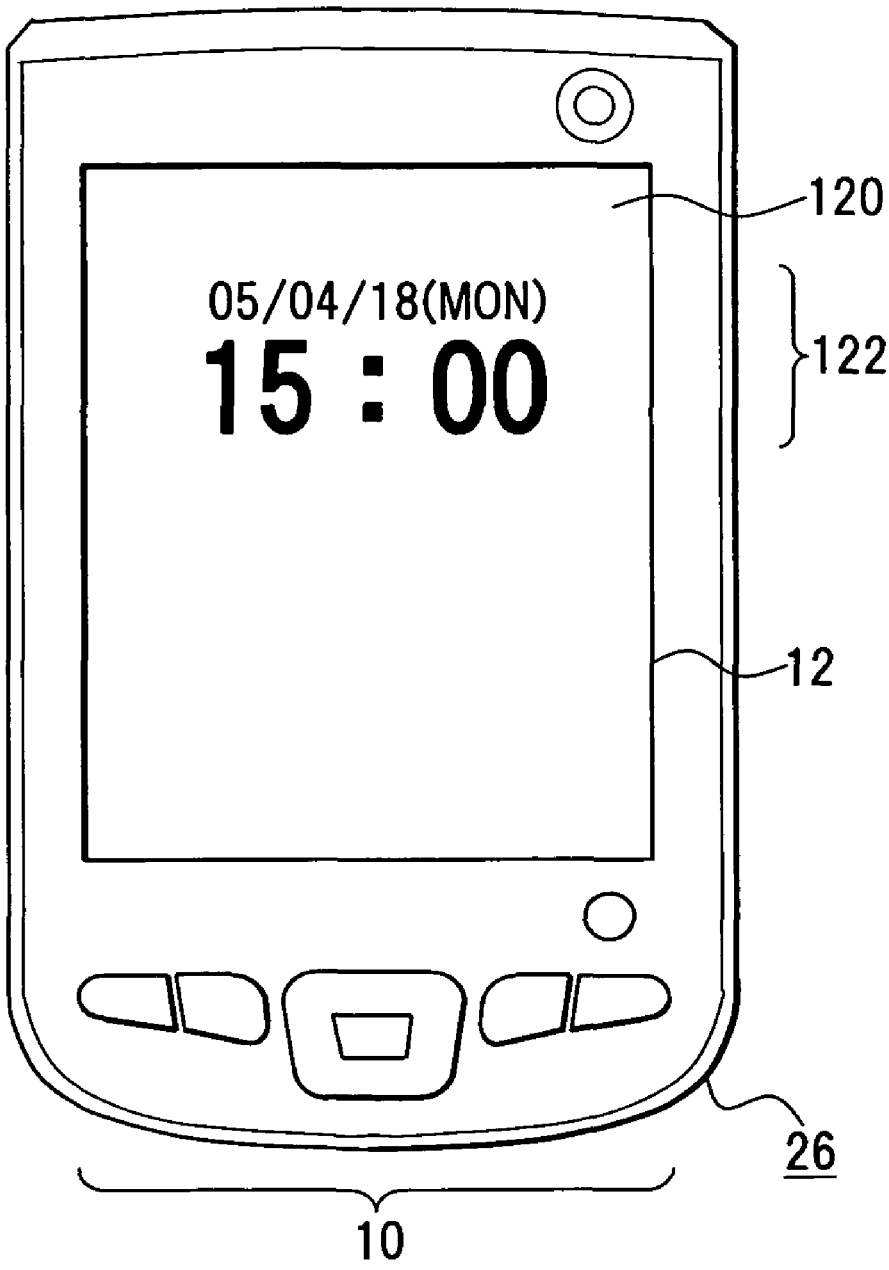
FIG. 18 is a front view of a PDA.
Figure 19A:
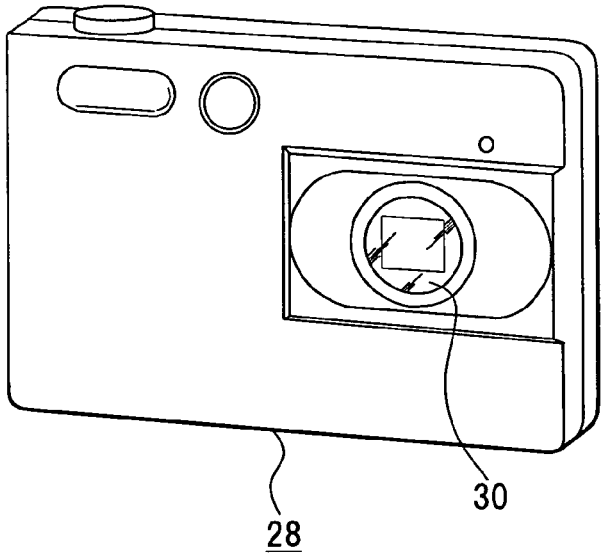
FIGS. 19A and 19B are perspective views of a camera.
Figure 19B:
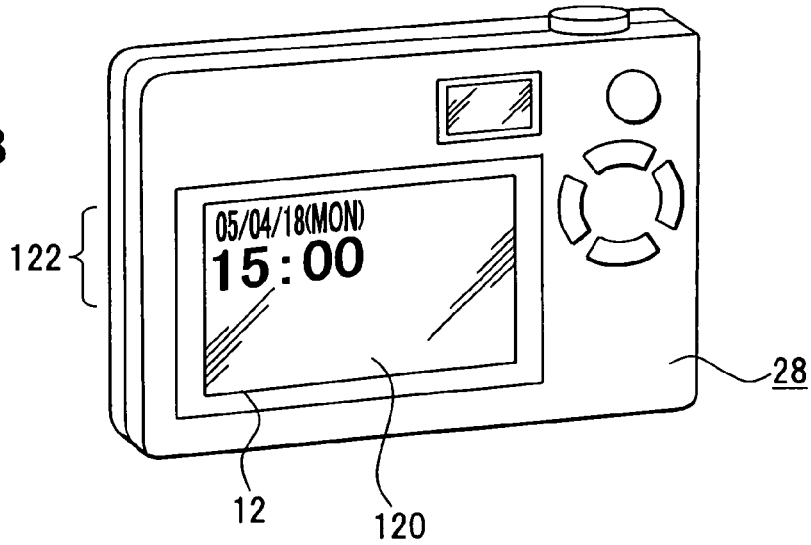

Other Embodiments (1) In the above-described embodiments, the descriptions have been given by exemplifying the mobile terminal device 2 such as mobile phones. However, the present invention can also be applied to any electronic devices as long as a device correct its device side time with a time correction information supplied from outside the device. For example, as shown in FIG. 17, the present invention can be applied to a PC (personal computer) 24, or to a PDA (Personal Digital Assistant) 26 shown in FIG. 18, or to a camera 28 shown in FIGS. 19A and 19B. FIG. 19A is a front view of the camera 28, and the reference numeral 30 indicates a lens part. FIG. 19B is a rear view of the camera 28. In these FIGS. 17, 18, 19A and 19B, the same symbols are assigned to parts identical to the mobile terminal device 2 in FIGS. 1 and 2, and the explanation is omitted. In such electronic devices, time correction can be performed appropriately and wrong correction can be prevented as well. In addition to these devices, the present invention can also be applied to a clock, a radio receiver, a TV receiver and so on, and the same effect can be expected.

(2) In the above-described embodiments, the time correction inhibiting periods T1 to T4 have been set. However, these periods may be selected arbitrary from a control selection menu. In that case, it is possible to set T1 as compulsory while other periods T2 through T4 are set as selectable; or it is also possible to set T1 and T2 as compulsory while other periods T3 and T4 are set as selectable.

(3) In the above-described embodiments, a configuration has been used in which the framework side makes a judgment whether any of the time correction inhibiting periods is applicable or not and lets each function, i.e., each program to perform its time correction based on the judgment. However, it is also possible to configure the time management program side to manage any operations pertaining to time collectively and perform time correction.

A most preferred embodiment and the like of the present invention have been described above. However, the present invention is not limited to the above description; it goes without saying that various modifications and alterations may be made by a person skilled in the art on the basis of the gist of the invention that is described in the claims and disclosed in the detailed description of the invention, and that such modifications and alterations are included in the scope of the present invention.

The present invention relates to an electronic device that corrects its device side time with a time correction information supplied from outside the device, and enables to perform a time correction by setting correction inhibiting periods against the time correction information or by retaining the time correction information. Thus the present invention is useful since the time correction can be performed appropriately without affecting the operations of the device side and accuracy of the device side time can be improved.

What is claimed is:

1. An electronic device that corrects its device side time with time correction information supplied from outside the device, comprising:

a reception section that receives the time correction information;

a time correction section that judges, when the reception section receives the time correction information, whether a correction inhibiting period is set or not, then either discards the time correction information if the correction inhibiting period is set, or corrects the device side time with the time correction information that the reception section receives if the correction inhibiting period is not set;

a memory section that stores application programs using the device side time; and a control section that executes the application programs, wherein each of the application programs sends starting notifications to the control section when the application programs start time correction process in response to receipt of the time correction information, and end notifications to the control section when the application programs end the time correction process, and the correction inhibiting period is set between a first notification of the starting notifications and a last notification of the end notifications.

2. A time correction method of an electronic device that corrects its device side time with time correction information supplied from outside the device, comprising:

receiving the time correction information;

executing application programs using the device side time, the application programs being stored in a memory section;

sending starting notifications by each of the application programs when the application programs start time correction process in response to receipt of the time correction information, and end notifications by each of the application programs when the application programs end the time correction process;

setting a correction inhibiting period between a first notification of the starting notifications and a last notification of the end notifications;

judging, when the time correction information is received, whether the correction inhibiting period is set or not; and discarding the time correction information if the correction inhibiting period is set, or correcting the device side time with the received time correction information if the correction inhibiting period is not set.

3. A time correction program executed by a computer, the time correction program of an electronic device that corrects its device side time with time correction information supplied from outside the device, comprising:

receiving the time correction information;

executing application programs using the device side time, the application programs being stored in a memory section;

sending starting notifications by each of the application programs when the application programs start time correction process in response to receipt of the time correction information, and end notifications by each of the application programs when the application programs end the time correction process;

setting a correction inhibiting period between a first notification of the starting notifications and a last notification of the end notifications;

judging, when the time correction information is received, whether the correction inhibiting period is set or not; and discarding the time correction information if the correction inhibiting period is set, or correcting the device side time with the received time correction information if the correction inhibiting period is not set.

4. A mobile terminal device that corrects its device side time with time correction information supplied from base stations, comprising:

a reception section that receives the time correction information;

a time correction section that judges, when the reception section receives the time correction information, whether a correction inhibiting period is set or not, then either discards the time correction information if the correction inhibiting period is set, or corrects the device side time with the time correction information that the reception section receives if the correction inhibiting period is not set;

a memory section that stores application programs using the device side time; and a control section that executes the application programs, wherein each of the application programs sends starting notifications to the control section when the application programs start time correction process in response to receipt of the time correction information, and end notifications to the control section when the application programs end the time correction process, and the correction inhibiting period is set between a first notification of the starting notifications and a last notification of the end notifications.

* * * * *